United States Patent [19]

Schoepe et al.

[11] Patent Number: 4,907,302

[45] Date of Patent: Mar. 13, 1990

[54] IN-FIELD INSTALLABLE CLOSING DELAY CUP

[75] Inventors: Adolf Schoepe; Oscar R. Dufau, both of Fullerton, Calif.

[73] Assignee: Fluidmaster Inc., Anaheim, Calif.

[21] Appl. No.: 150,739

[22] Filed: Feb. 1, 1988

[51] Int. Cl.[4] ..... E03D 1/34

[52] U.S. Cl. ..... 4/382; 4/379; 4/386

[58] Field of Search ..... 4/382, 379, 386, 378, 4/392, 393, 395, 402, 404, 389

[56] References Cited

U.S. PATENT DOCUMENTS 2,773,268 12/1956 Hurko et al. ..... 4/393

3,142,846 8/1964 Lackenmaier et al. ..... 4/393

*Primary Examiner*—Henry J. Recla

*Assistant Examiner*—Edward C. Donovan

*Attorney, Agent, or Firm*—Freilich, Hornbaker, Rosen & Fernandez

[57] ABSTRACT

An improvement is provided for toilet flush valves on tanks which contain insufficient water to flush properly, which leads to waste of water by double flushing. The improvement enables in-field modification of the flush valve to substantially completely empty the tank. A closing delay device (42, FIG. 1) which includes a cup (64), is attached directly to the top of the tank ball (32) for easy installation, and is tall enough so that when the tank ball is pivoted to the fully opened position the cup is pivoted to a side of the pivot axis (28) opposite the tank ball to delay closing of the flush valve. The tank ball is formed of soft rubber and has an upwardly extending tubular extension (74) with an annular groove therein, which closely receives an annular flange at the bottom of the delay cup device.

10 Claims, 2 Drawing Sheets

FIG. 1
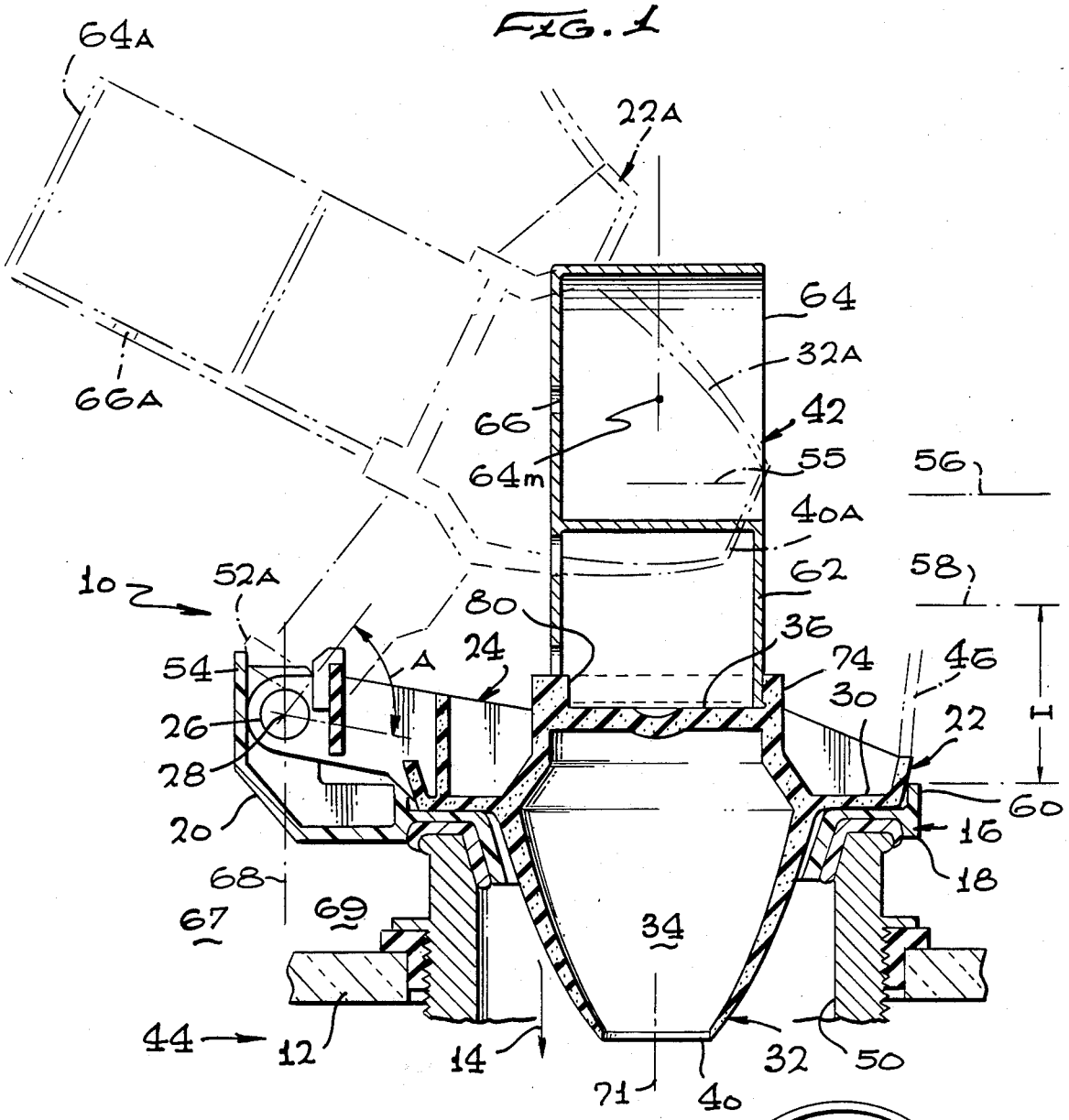
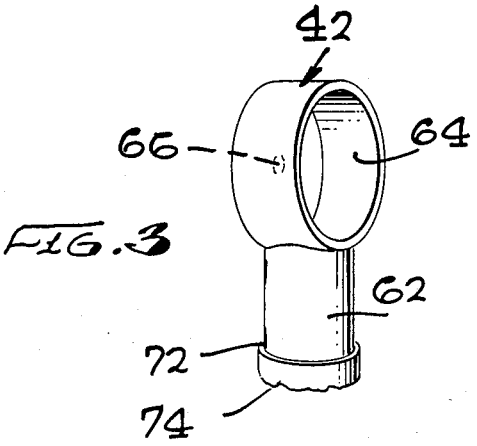
FIG. 3
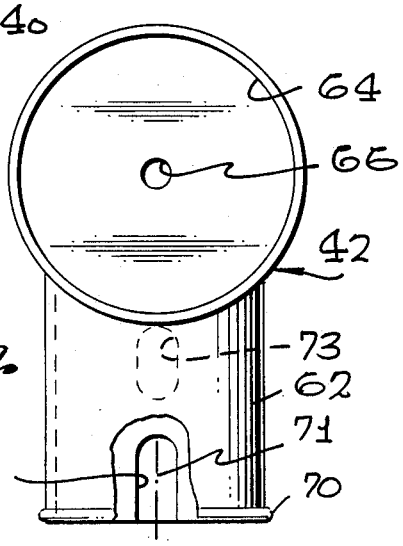
FIG. 4

FIG. 2
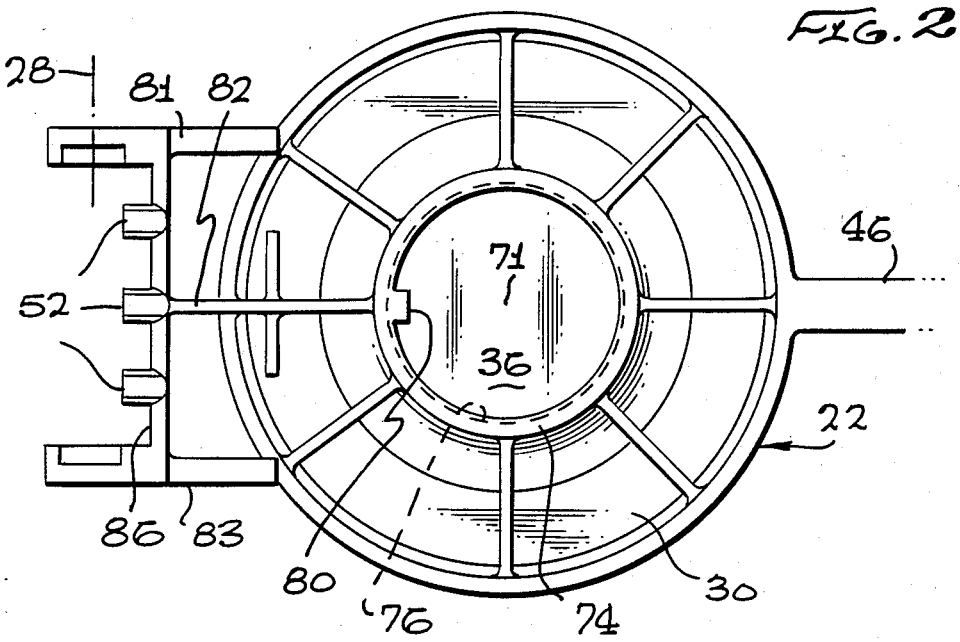
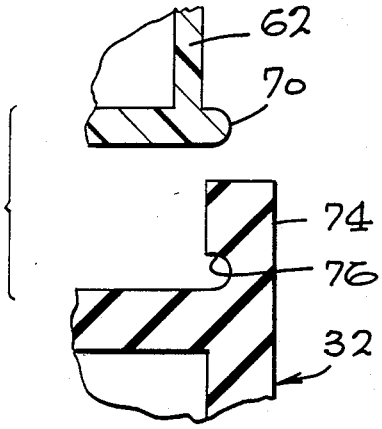
FIG. 5
FIG. 6
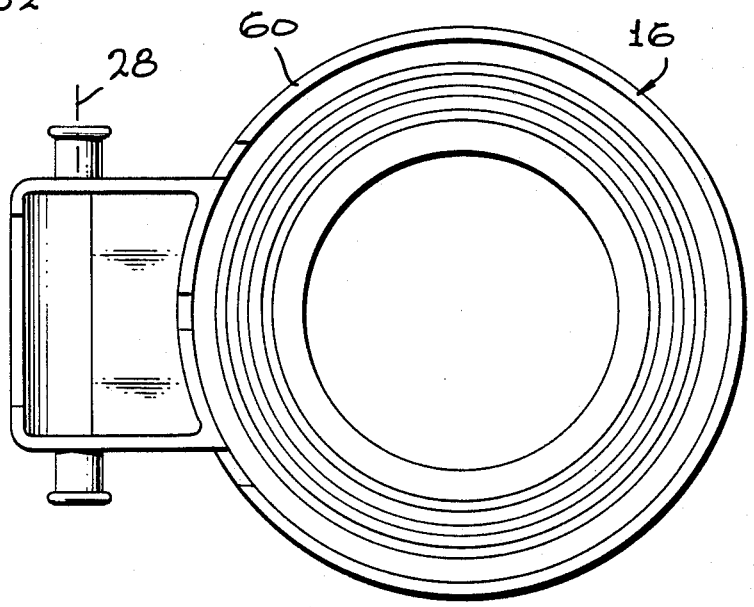

IN-FIELD INSTALLABLE CLOSING DELAY CUP

BACKGROUND OF THE INVENTION

A common type of flush valve for flushing water from a tank or water closet to a toilet bowl, includes a valve member pivotally mounted on a valve seat, the valve member including a hollow tank ball. When the valve member is pivoted up a short distance from the seat, the large buoyancy of the tank ball causes it to "pop" open to allow water to rapidly pass out of the water closet. When the tank ball pivots up, it partially fills with water so its buoyancy is reduced, although it still has positive buoyancy. As water in the water closet drops to the level of the open tank ball, the tank ball floats near the water surface and starts to pivot down as the water level falls. As the tank ball approaches the valve seat through which water is rapidly flowing, suction causes the tank ball to suddenly move down and close the flush valve, while a few inches of water remain in the water closet above the level of the valve seat. Older water closets typically had capacities of 5 to 7 gallons which was more than adequate to fully flush a toilet bowl. The retention of a few inches of tank water in such water closets did not noticeably affect flushing but had the advantage of saving on water usage.

Many modern toilets have water closet of reduced capacity, to hold perhaps 3½ gallons of water, to reduce the required height of the water closet to save on water usage, and sometimes also for aesthetic purposes. The economical and reliable prior flush valves which include a hollow tank ball on the valve member, are commonly installed in such toilets. Although the toilets often function well, there are many cases in which flushing is not complete because of insufficient flushing water passing through the toilet bowl in each flushing cycle. This results in double flushing, which results in wasting considerable water in an installation that may have been made to save water. Whether the toilet will flush well depends upon many factors such as whether and at what angle the flush valve seat is angled from the vertical, and by what angle the valve seat pivots to its open position. It would be desirable if an economical and reliable prior type flush valve could be used in modern toilets having water closets of reduced capacity, and yet if such installed valves could be modified rapidly and at low cost without disassembling them, when required to increase the amount of flush water.

SUMMARY OF THE INVENTION

In accordance with one embodiment of the present invention, a method and apparatus are provided for modifying a prior type of toilet flush valve, to increase the amount of flush water in each cycle of operation, which enables the modification to be conducted easily and at low cost and in the field. An increased flow of flushing water is obtained by attaching a closing delay cup device directly to the top of the tank ball of the valve member. The tank ball, which is formed of soft rubber, can be formed to include an upwardly extending tubular extension having a groove at its side. The cup device can include an annular flange that can be fitted into the annular groove by deforming the soft rubber extension.

The novel features of the invention are set forth with particularity in the appended claims. The invention will be best understood from the following description when read in conjunction with the accompanying drawings.

BRIEF DESCRIPTION OF THE DRAWINGS

FIG. 1 is a sectional side view of a flush valve shown mounted on a water closet, with a closing delay cup device installed thereon.

FIG. 2 is a plan view of the valve member of FIG. 1, with the cup device not installed thereon.

FIG. 3 is a perspective view of the cup device shown installed on the valve member of FIG. 1.

FIG. 4 is a front elevation view of the cup device of FIG. 3.

FIG. 5 is an exploded view of a portion of the apparatus of FIG. 1.

FIG. 6 is a plan view of the valve seat device of FIG. 1.

DESCRIPTION OF THE PREFERRED EMBODIMENT

FIG. 1 illustrates a toilet flush valve 10 which controls the flow of water from a water closet 12 in the direction of arrow 14 to a toilet bowl (not shown) to flush waste out of the bowl. The valve includes a valve seat device 16 that forms a seat 18 and a pivot mount 20 that is spaced largely horizontally from the seat. A valve member 22 includes an arm 24 with an inner end 26 pivotally mounted about an axis 28 on the pivot mount of the valve seat device. The valve member also includes a seal portion 30 that can seal against the valve seat 18, and a tank ball 21 lying within the seal portion. The tank ball forms a chamber 34 and is closed at the top 36 and sides, but the chamber has an open bottom end 40. A closing delay cup device 42 can be mounted on the top 36 of the tank ball.

In the absence of the cup device 42, the flush valve 10 is of generally the same configuration and operates in substantially the same manner as a prior art flush valve. To flush the toilet 44 which includes the water closet and toilet bowl, a user pivots a handle (not shown) to lift strap 46 that pivots open the valve member 22 by a limited angle. The high degree of buoyancy of the tank ball 32 causes it to rapidly rise, or "pop" up, despite the forces of water rapidly emptying through the valve seat 16 and a mounting conduit 50 that tend to push down the valve member. The valve member pivots to the position 22A at which the open bottom end 40A of the tank ball faces primarily horizontally rather than vertically down. In the open position 22A of the valve number, a stop portion 52A on the valve member abuts a limitor 54 on the pivot mount 22 of the valve seat device. During such opening of the valve member, about half of the air trapped in the tank ball **32*a* is lost. However, the tank ball and valve member are still positively buoyant because of trapped air above level 55**.

As water empties from the water closet and reaches a first level 56, the tank ball starts to fall while it floats on the water surface (in the absence of the cup device 42). When the water reaches a second lower level 58, the water rushing out of the valve seat drags the valve member down until it seats on the valve seat 18. Water from an inlet valve (not shown) gradually fills the water closet again to its original level.

When the above flush valve (without the cup device) is used in a common older water closet containing about 5 to 7 gallons of water, it is not generally detrimental that a substantial amount of water lies along the height H between a rim 60 around the valve seat and the second water level 58. Actually, with water conservation now generally being desirable, leaving this amount of water is advantageous. However, when this flush valve is used in some more recently-installed water closets which may have a capacity of about 3½ gallons, to conserve water and/or allow a water closet of reduced height to be used, the fact that substantial water remains after flushing may sometimes be deleterious. Depending upon the size of the toilet bowl, the size and configuration of the pipes leading to and from it, and the type and quantity of waste most commonly to be flushed, the flush valve (without the cup device) may or may not flush properly. It is often not possible to determine this until after the flush valve is installed and has been used for a while. Improper flushing generally leads to double flushing, which wastes a considerable amount of water.

In accordance with the present invention, if the flush valve, without the cup device 42 thereon, has been installed in a smaller water closet and is found to not flush properly because of insufficient flush water discharged in each cycle, the closing delay cup device 42 can be installed to enhance flushing. The cup device 42 includes a cylindrical lower portion 62 that amount at the top 36 of the tank ball, and an upper portion forming a cup 64. The basic idea of a closing delay cup is known in the prior art, as shown in U.S. Pat. Nos. 2,773,268; 3,142,846; and 4,365,365. When the valve member pivots to the open position 22A, the cup at 64A can hold water and also lies on a second horizontal side 67 of a vertical plane 68 passing through the pivot axis 28, which is opposite a first side 69 on which the valve seat 18 lies. As the water lever rapidly drops in the water closet during flushing, water is left in the cup at 64A and drains out through a drainage hole 66A more slowly than the water level falls in the water closet. The weight of water in the cup at 64A prevents the valve member from pivoting to the closed position until some of the water has drained out through the drain hole 66A. When the valve member then closes, the height of water above the valve seat rim 60 will be less than H, and generally will be substantially zero.

As shown in greater detail in FIGS. 3–5, the lower portion 62 of the cup device is substantially cylindrical and centered on a generally vertical axis 71 of the tank ball. The middle 64 m of the cup lies substantially on this vertical axis. The lower portion of the cup device has a radially outwardly-extending flange 70 at its lower end. The flange in annular and extends around almost the entire periphery of the cylindrical lower portion 62, being interrupted only at a slot 72. The tank ball 32 (FIG. 5) includes an upwardly projecting tubular extension 74 that forms a radially-extending groove 76 that can closely receive the annular flange 70 on the cup device. To install the cup device on the tank ball, a person aligns the slot 72 (FIG. 4) in the cup device with a stop 80 (FIG. 2) formed at one side of the tubular extension, and deforms the tubular extension 74 to seat the flange 70 in the annular groove 76.

The tank ball 32 (and the rest of the valve member) is formed of a soft resilient material, preferably rubber of low shore hardness such as 55. The cup device 62 is formed of a stiffer material such as a molded rigid plastic, and once installed on the tank ball will reliably remain in place. It may be noted that the slot 72 (FIG. 4) is wider than the stop 80, which facilitates installation by allowing a person to radially squeeze the bottom of the tubular portion 62 of the cup device to slightly reduce its diameter during installation of the flange in the groove. Thereafter, the bottom of the cup device tends to return to its expanded position. Any water lying in the lower portion 62 of the cup device can drain out through slot 72 at the same time as water drains out of the cup 64A (FIG. 1), the lower portion 62 being provided with another hole 73 above slot 72 that can allow air to enter the lower portion as water drains out of slot 72.

The valve member 22 is a one-piece integral molded part of soft rubber, that includes the tank ball 32, the seal portion 30, and the arm 24, which includes three vertical beams 81–83. Since the tank ball 32 has a fairly large diameter and its largely vertical center line or axis 71 lies far from the horizontal pivot axis 28, the mounting of the cup device 42 on top of the tank ball provides several advantages. Only a small tubular extension 74 has to be added at the top of the tank ball to provide a wide mounting platform for the cup device. The tubular extension has a diameter more than half the tank ball diameter at the widest point of its chamber. At the mounted position the cup device lies far from the pivot axis 28. By forming the cup device with the cup 64 spaced above the top of the tank ball (by its lower portion 62) by over half the horizontal distance of the pivot axis 28 to the cup middle 64m, the cup moves a considerable distance horizontally when the valve member opens and the cup moves to the position 64A (on the side 67 of the pivot axis 28). The fact that the cup device is a separate part that can be detachably mounted in the field, without the need for screws or other fasteners, reduces the number of parts and simplifies installation.

Applicant provides three stop portions 52 (FIG. 2) on the arm of the arm of the valve member, to limit the angle by which the valve member pivots in moving to its open position. The stop portions 52 are located on a cross beam 86 of the valve member and project upwardly therefrom. The projecting parts of the stop portions 52 can be easily trimmed with a scissors or knife to increase the angle of pivoting of the tank ball. The angle A of pivoting is generally over 45° and may be adjustable from 60° (seen in FIG. 1) to a maximum of 85°. In some toilets the valve seat 18 must be mounted with its sealing surface inclined from the horizontal, and trimming of the stop portions enables some control of the angle of the open valve member to assure proper operation for such water closets. The trimmable stop portions which enable control of valve member pivoting, are preferably trimmed only after the cup device 42 is installed.

When the cup device is installed, it is desirable to close the flush valve very close to the time when the water level in the water closet drops to the level of the top of the seat rim 60. If there is a further delay, then new water entering the water closet to refill it will be drained out of the valve seat. Such new water flows slowly enough that it does not really aid flushing, and yet causing wastage of water from a water closet intended to save water. Although it would be possible to enable a change in the size of the drainage hole 66A (FIG. 1) of the cup to control the time when the valve closes, this is difficult to do properly in the field. Instead, by trimming the stop portions 52, a person can control the torque or moment (weight of the cup device with water in it times the horizontal distance between the center of gravity of the cup and the pivot axis 28) applied by the cup device to keep the valve member. The cup device is constructed so that when the stop portions 52 are not trimmed the valve member will close slightly before the water drops to the level of the seat rim. If it is found that in a particular installation the valve is closing too early and additional flush water is required, the top parts of the stop portions 52 can be trimmed away to keep the valve open longer (the valve will close when there is still some water in the cup at 66A).

Thus, the invention provides a flush valve which can be constructed reliably and at low cost to operate well in larger water closets and some smaller water closets, but which enables a controllable delay in closing for smaller water closets where such delay is necessary to increase the flushing water for proper flushing. This is accomplished by providing a cup device that is field-installable on a valve member that operates reliably but leaves a moderate amount of water in the tank without the cup device. The tank ball of the valve member is provided with an upwardly projecting tubular extension with a groove that receives a flange at the bottom of the cup device. The cup device includes a cylindrical lower portion that holds the cup a distance above the top of the tank ball so the cup moves to an opposite side of the axis when the valve member pivots open.

Although particular embodiments of the invention have been described and illustrated herein, it is recognized that modifications and variations may readily occur to those skilled in the art and consequently it is intended to cover such modifications and equivalents.

What is claimed is:

1. A method for modifying a toilet flush valve which includes a valve member that has an inner end pivotally mounted about an axis and that has an outer end coupled to a chain device for flushing, wherein the outer end includes a tank ball that forms a largely closed chamber with an open bottom, the tank ball being highly buoyant when it is first pivoted from a closed position on a valve seat wherein the bottom faces primarily downward when the water closet is full, toward an open valve position wherein the tank ball bottom faces more horizontally and is less buoyant to close only when the water level drops to a predetermined low level wherein the water closet is primarily but not completely empty, the improvement for use when the water tank has a limited capacity and the toilet bowl does not completely flush, comprising:

attaching a closing delay cup device which includes a cup with a drainage hole, to said tank ball, so the cup lies on a horizontal side of said axis opposite said seat when the valve member is open and lies on the same side of said axis as said seat when the valve member is closed, said drainage hole being small enough that most of the water lying in said water closet between said predetermined low level and the level of said valve seat drains out through said seat before said cup is light enough to allow said valve member to close, said flush valve being pivotally mounted and attached to the chain device independently of said closing delay cup device, whereby to enable use of a reliable valve and to minimize water consumption when the valve has been installed in a large tank, while enabling complete flushing when the valve has been installed in a small tank.

2. The method described in claim 1 wherein:

said valve member has a stop portion which, in the open position, abuts a limiter that is fixed relative to said water closet to limit the angle of pivoting of the valve member, and including:

adjusting said stop portion to control the angle of pivoting of said valve member, to control the relative movement of said cup that urges said valve member to remain open and the relative movement of said tank ball that urges said valve member to pivot closed, when water drops below said low level, to thereby control the amount of delay added by said cup device without having to control the size of said drain hole.

3. In a toilet flush valve which includes a seat member with a seat leading from a water closet to a toilet bowl, a valve member having an inner end which is pivotally mounted about a horizontal pivot axis in the water closet and an outer end which has a part attached to a chain device, wherein the outer end includes a tank ball, and wherein the valve member can pivot between a closed position wherein the tank ball lies substantially at the level of the seat and an open position wherein the tank ball lies above the seat, and wherein the tank ball always lies on a first horizontal side of said axis and is highly buoyant as the valve member is opened in a full water closet but the tank ball is much less buoyant though still buoyant thereafter to keep the valve member open during most of the drop in water level from a full water closet level and to close the valve member when the water level in the water closet falls to a low level lying at least an inch above the level of said seat, the improvement comprising:

a closing delay cup device having a cup with a drain hole and having a mount mountable on said tank ball while said valve remains pivotally mounted in said water closet, to hold said cup on said first horizontal side of said axis when said valve member is closed, and on an opposite second side of said axis when said valve member is open, said drain hole being small enough and said cup being positioned far enough on said second side in the open valve position that the water level drops by a majority of the height of said low level above said valve seat before said valve closes, said flush valve being pivotally mounted and attached to the chain device independently of said closing delay cup device, whereby to enable a reliable valve member to be used and to minimize water consumption when the valve has been installed in a large water closet while enabling complete flushing when the valve has been installed in a small tank and incomplete flushing occurs before the cup device has been installed.

4. The improvement described in claim 3 including:

a stop on said valve member, and means forming a limiter which engages said stop in the open position of the valve member to limit the angle of pivoting of the valve member from said closed position to said open position; and means for adjusting said angle of pivoting at which said stop engages said limiter, whereby to more accurately control the time of valve closing.

5. In a toilet flush valve which includes a valve seat leading from a water closet to a toilet bowl, a valve member which includes a tank ball and which is pivotally mounted about a horizontal pivot axis in the water closet to pivot between a closed position wherein the tank ball lies substantially at the level of the seat and an open position wherein the tank ball lies above the seat, and wherein the tank ball always lies on a first horizontal side of said axis and is highly buoyant as the valve member is opened in a full water closet but the tank ball is much less buoyant though still buoyant thereafter to keep the valve member open during most of the drop in water level from a full water closet level and to close the valve member when the water level in the water closet falls to a low level lying at lease an inch above the level of said seat, the improvement wherein:

said tank ball has an upwardly projecting largely cylindrical extension part at its top; and including:

a closing delay cup device which includes a cylindrical lower mount part and a cup at the top of said mount part;

one of said parts forming a radially-extending annular groove and the other part forming a radially-extending flange that fits into said groove and holds said cup device extending vertically upwardly from the top of said tank ball in the closed position of said valve member.

6. A method for modifying a toilet seat flush valve which includes a tank ball that forms a largely closed chamber with an open bottom, and that is highly buoyant when it is first pivoted about an axis from a closed position on the valve seat, wherein the bottom faces primarily downward when the water closet is full, toward an open valve position wherein the tank ball bottom faces more horizontally and is less buoyant to close only when the water level drops to a predetermined low level wherein the water closet is primarily but not completely empty, the improvement for use when the water tank has a limited capacity and the toilet bowl does not completely flush, comprising:

attaching a closing delay cup device which includes a cup with a drainage hole, to said tank ball, so the cup lies on a horizontal side of said axis opposite said seat when the valve member is open and lies on the same side of said axis as said seat when the valve member is closed, said drainage hole being small enough that most of the water lying in said water closet between said predetermined low level and the level of said valve seat drains out through said seat before said cup is light enough to allow said valve member to close;

said tank ball being formed of soft resilient material while said cup device is of harder material, and said step of attaching includes forcing an outwardly projecting annular flange at the bottom of said cup device into an annular groove formed at the top of said tank ball, whereby to enable field installation without fasteners.

7. In a toilet flush valve which includes a valve seat leading from a water closet to a toilet bowl, a valve member which includes a tank ball and which is pivotally mounted about a horizontal pivot axis in the water closet to pivot between a closed position wherein the tank ball lies substantially at the level of the seat and an open position wherein the tank ball lies above the seat, and wherein the tank ball always lies on a first horizontal side of said axis and is highly buoyant as the valve member is opened in a full water closet but the tank ball is much less buoyant though still buoyant thereafter to keep the valve member open during most of the drop in water level from a full water closet level and to close the valve member when the water level in the water closet falls to a low level lying at lease an inch above the level of said seat, the improvement comprising:

a closing delay cup device having a cup with a drain hole and having a mount mountable on said tank ball while said valve remains pivotally mounted in said water closet, to hold said cup on said first horizontal side of said axis when said valve member is closed, and on an opposite second side of said axis when said valve member is open, said drain hole being small enough and said cup being positioned far enough on said second side in the open valve position that the water level drops by a majority of the height of said low level above said valve seat before said valve closes;

said tank ball has a top and an upwardly projecting cylindrical extension at the top and a radially-extending groove in said extension, and said mount of said cup device has a bottom end forming a flange that is closely receivable in said groove.

8. The improvement described in claim 7 wherein: said mount of said cup device comprises a vertically-extending tube, and said cup comprises a horizontally-extending tube with a closed end lying at the top of said mount.

9. A toilet flush valve comprising: a valve seat device forming a seat and forming a pivot mount defining a pivot axis spaced largely horizontally from said seat;

a valve member pivotally mounted on said seat device between open and closed positions respectively away from and against said seat, and wherein said valve member has buoyancy which urges it to remain away from said seat after being pulled off said seat, said valve member having a mount portion lying above said seat, said valve member forming a closing delay cup device that include an upper portion forming a cup with a drain hole, said cup positioned to lie on a horizontal side of said axis opposite said seat when said valve member is pivoted open, said cup device having a lower mount portion which is mountable on said mount portion of said valve member, one of said mount portions forming an annular groove and the other forming an annular flange that fits closely in said annular groove, one of said mount portions being formed of resilient material, whereby to facilitate field installation.

10. The valve described in claim 9 wherein: said valve member has a top and said valve member mount portion includes a tubular extension projecting upwardly at said top, said tubular extension including an internal annular groove forming said groove, and said mount portion of said cup device includes a cylindrical lower portion which forms an outwardly extending annular flange that forms said flange;

said tubular extension forming a radially inwardly extending stop, and said cylindrical portion of said cup device forms a slot at the bottom that is wider than said stop, to permit compression of said cylindrical portion to fit its flange into said groove and also to receive said stop.

* * * * *